US005298369A

United States Patent [19]

Munshi et al.

[11] Patent Number: 5,298,369

[45] Date of Patent: Mar. 29, 1994

[54] USE OF COLLOIDAL SILVER TO IMPROVE PUSH PROCESSING OF A REVERSAL PHOTOGRAPHIC ELEMENT

[75] Inventors: Jal F. Munshi, Rochester; Henry J. Sniadoch, Canandaigua; Richard C. Tuites, Rochester, all of N.Y.

[73] Assignee: Eastman Kodak Company, Rochester, N.Y.

[21] Appl. No.: 76,334

[22] Filed: Jun. 14, 1993

Related U.S. Application Data

[63] Continuation-in-part of Ser. No. 810,044, Dec. 19, 1991, abandoned.

[51] Int. Cl.[5] ..... G03C 1/09; G03C 1/494

[52] U.S. Cl. ..... 430/379; 430/605; 430/617; 430/438; 430/407; 430/448; 430/507

[58] Field of Search ..... 430/379, 605, 617, 504, 430/438, 407, 448, 507

[56] References Cited

U.S. PATENT DOCUMENTS

| | | | |
|---|---|---|---|
| H1015 | 1/1992 | Usui et al. | 430/379 |
| 2,336,327 | 12/1943 | Weissberger et al. | 430/505 |
| 3,737,317 | 6/1973 | Nicholas et al. | 430/505 |
| 3,945,829 | 3/1976 | Zorn et al. | 430/507 |
| 4,082,553 | 4/1978 | Groet | 430/505 |
| 4,525,449 | 6/1985 | Nakajima et al. | 430/407 |
| 4,554,245 | 11/1985 | Hayashi et al. | 430/567 |
| 4,576,907 | 3/1986 | Kampfer et al. | 430/507 |
| 4,626,498 | 12/1986 | Shuto et al. | 430/379 |
| 4,717,648 | 1/1988 | Ueda et al. | 430/379 |
| 4,788,132 | 11/1988 | Deguchi et al. | 430/505 |
| 4,886,738 | 12/1989 | Deguchi et al. | 430/510 |
| 4,925,777 | 5/1990 | Inoue et al. | 430/377 |
| 5,009,993 | 4/1991 | Inoue et al. | 430/605 |

FOREIGN PATENT DOCUMENTS

| | | | |
|---|---|---|---|
| 0127081 | 12/1984 | European Pat. Off. . | |
| 228561A | 12/1985 | European Pat. Off. . | |
| 0332192 | 9/1989 | European Pat. Off. . | |
| 0426181A2 | 10/1990 | European Pat. Off. . | |
| 61077849A | 9/1984 | Japan . | |
| 1519993 | 8/1978 | United Kingdom | 430/504 |

OTHER PUBLICATIONS

*Research Disclosure*, Mar. 1975 #13116.

*Primary Examiner*—Charles L. Bowers, Jr.
*Assistant Examiner*—Mark F. Huff
*Attorney, Agent, or Firm*—Gordon M. Stewart

[57] ABSTRACT

When color reversal materials are developed by a process that comprises prolonged contact with the first, or black-and-white developer, images with a color mismatch or speed deficiency can occur. Such undesirable results can be reduced or eliminated by including in the reversal material, a layer of colloidal elemental silver. The layer can be adjacent to a light sensitive, silver halide-containing layer, which is present within a color record who's speed is to be increased in order to reduce the color mismatch. The amount of colloidal elemental silver employed is less than that used in the art to protect an underlying light sensitive, silver halide layer from exposure by unwanted light.

19 Claims, 1 Drawing Sheet

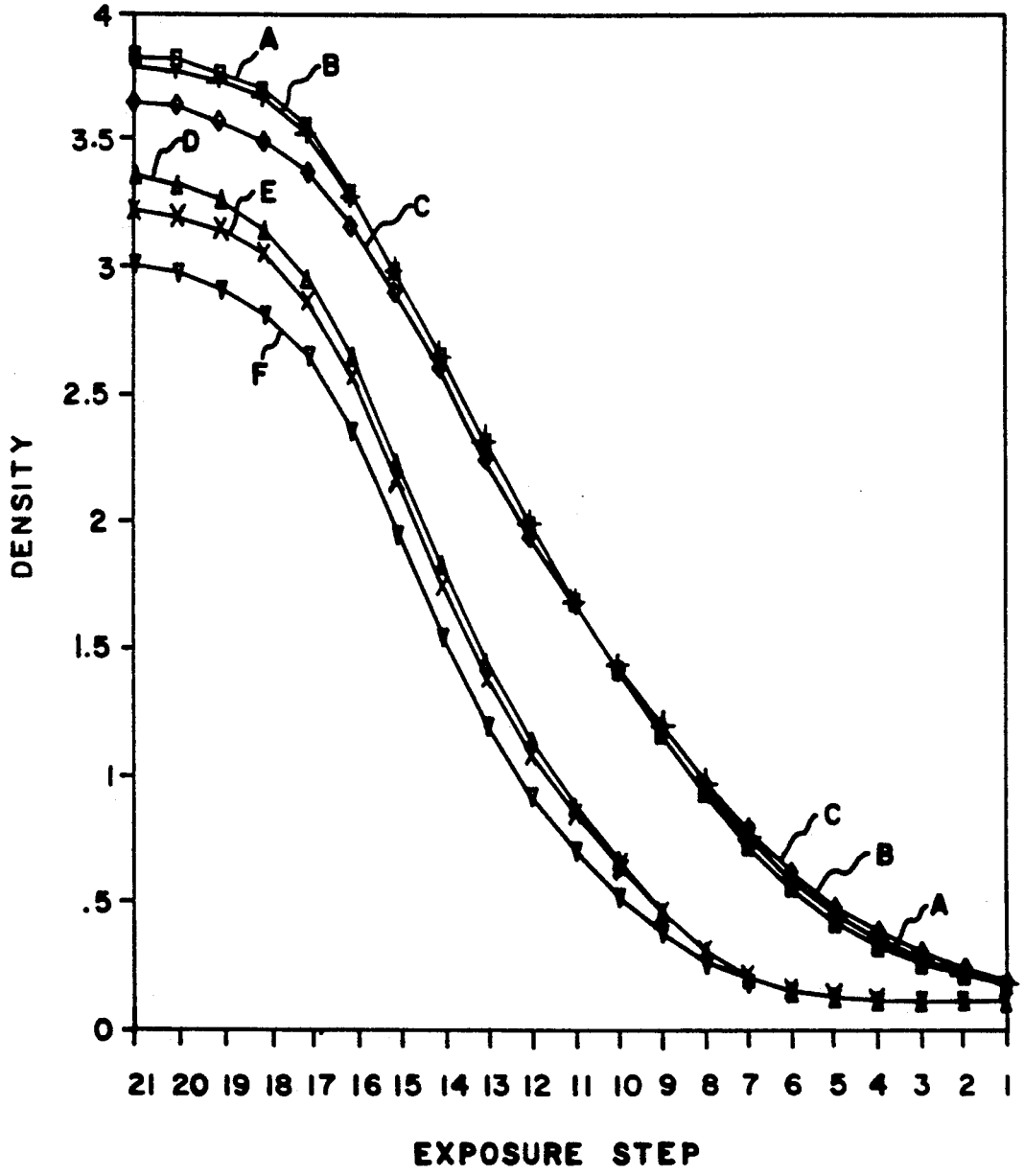
4
3.5
3
2.5
2
1.5
1
.5
0
DENSITY
A
B
C
D
E
F
C
B
A
21 20 19 18 17 16 15 14 13 12 11 10 9 8 7 6 5 4 3 2 1
EXPOSURE STEP

USE OF COLLOIDAL SILVER TO IMPROVE PUSH PROCESSING OF A REVERSAL PHOTOGRAPHIC ELEMENT

CROSS-REFERENCE TO RELATED APPLICATIONS

This application is a continuation-in-part of U.S. patent application Ser. No. 810,044 filed Dec. 19, 1991 under the title "Reversal Photographic Element and Processing Thereof", now abandoned.

FIELD OF THE INVENTION

This invention relates to processing of color reversal materials, e.g. film. More particularly, it relates to processing of such materials by a method which comprises prolonged contact with the first, or black-and-white developer; i.e. "push processing". In another aspect, this invention relates to the inclusion of elemental colloidal silver in color reversal materials, for the purpose of eliminating or reducing color mismatch or speed deficiency problems that are produced by push processing.

BACKGROUND OF THE INVENTION

It is quite common for a photographer to intentionally expose a film at a speed faster than the speed for which the film was designed. For example, a photographer may expose a slow film at a faster speed at an athletic event, in order to photograph a participant or an object in rapid motion. In such instances, the exposed film will be developed for a longer time in order to compensate for the comparatively small amount of silver that was exposed. In color reversal processing, the prolonged development occurs in the first development, i.e. in the black and white development step. However, in many instances when such "push" processing is used, a mismatch of colors occurs in the resultant image. The degradation of color balance arises from differences in the relative developability of the three color sensitive layers in the film. For example, push processing can result in less speed gain in the green sensitive layer, resulting in an objectionable magenta color balance.

In the prior art, it is quite common for a color record in a color reversal film to achieve a speed by push processing which is different from the speed that is achieved by normal processing. This invention comprises the discovery that, when an efficacious amount of colloidal silver is in a layer that is operatively associated with a silver halide-based, light sensitive layer in a color record, push processing will confer a speed on the record, which is faster than that which would result if the colloidal silver layer was absent. The colloidal silver can be in a layer having a hydrophilic dispersing agent, such as gelatin.

Prior to this invention, it was not known that colloidal, elemental silver can overcome problems caused by push processing. In other words, it was not previously known that colloidal elemental silver in a color reversal film could reduce or eliminate color mismatches that result from black-and-white development of color reversal material for a prolonged time.

The improvements of this invention are considered to be a significant advance in the art. The invention provides photographic elements that have good push processing characteristics. This discovery was unexpected. Furthermore, the improved elements of this invention are readily prepared from known materials. In addition, the development methods of this invention are akin to those which are commonly employed throughout the world. Hence, this invention is readily adaptable by both the film manufacturing, and the film processing industries.

DESCRIPTION OF THE DRAWING

The drawing shows various plots of density as a function of exposure step, which is an expression of relative exposure, and also a function of or ("proxy") for log E. The plots illustrate the impact of colloidal silver on a yellow record of a multilayer film by push processing.

All curves illustrate results obtained using a color reversal material having (i) a slow yellow layer over (ii) an interlayer having varying amounts of Carey Lea silver, over (iii) another interlayer having no colloidal silver, over (iv) a fast magenta layer.

Curves A, B, and C illustrate behavior of various color reversal photographic elements in the black-and-white developer of the E-6 process for 6 minutes; the normal development time for the E-6 process. Curve A is a check; there is no colloidal silver in layer (ii) of the photographic element for which curve A was devised. Curves B and C represent results for similar photographic elements; however they have respectively, 2.2 and 24.8 mg of Carey Lea silver per $m^2$ in layer (ii). Unlike the check, these elements are within this invention.

Curves D, E, and F illustrate results obtained by push processing. In the instances illustrated, the push processing conditions were 11 minutes in the first (black-and-white) developer for process E-6.

Curve D is for the same photographic element for which curve A was derived. As can be seen, such films are faster when developed by push processing.

Curves E and F are for color reversal photographic elements (of this invention) utilized according to a method of this invention. More specifically, the method comprises push processing, and the elements are the same as those for which curves B and C were derived. It will be noted that the addition of 2.2 or 24.8 $mg/m^2$ of Carey Lea silver to interlayer (ii) increases the speed of the layer (curve F) compared to the layer (curve D) of the check film, and this speed gain is uniform through most of the exposure scale. This effect of colloidal silver is completely unexpected.

Similarly, it will also be noted that there is a loss in $D_{max}$ in the upper region of the photographic curve (curves B and C versus A). These density differences are much easier to compensate for by film building techniques within the skill of the art, than it is to achieve (by methods known in the art) the speed increases illustrated by the illustrative results at densities 1.0, 1.4, and 2, for example.

RELATED ART

Colloidal elemental silver has been suggested for a variety of uses in photographic elements. For example as mentioned above, preparations which are commonly known as Carey Lea silver, are used in photographic materials to protect underlying layers from exposure due to unwanted light. A colloidal silver preparation has been used in an antihalation layer as a carrier for compounds used to control fog generated by push processing. Carey Lea silver has also been used as a silver precipitating agent in the overcoat of a photographic element. Colloidal silver has also been used in a layer between green and red sensitive emulsion layers to enhance interlayer interimage effects on the green sensitive layer.

References which suggest the above uses do not teach the advantageous effects achieved in this invention by push processing. Moreover, the amounts of colloidal silver that are employed in the prior art to protect against unwanted light absorption are commonly far in excess of what is employed in this invention.

SUMMARY OF THE INVENTION

In one aspect, this invention provides an improved color reversal film suitable for push processing having from about 0.01 to about 43 mg per square meter (preferably less than about 20mg per square meter, more preferably no more than 15 mg per square meter, and even more preferably no more than 10 or even 5 mg per square meter) of colloidal elemental silver in a layer that is operatively associated with (and preferably below, that is, closer to the support than) a light sensitive, silver halide based layer of a color record; said film being further characterized by achieving, after exposure and subjecting said film to black and white development for a prolonged time, a photographic speed in said record which is faster than that achieved by said record by subjecting said film without said amount of colloidal silver to development with said black and white developer under substantially similar processing conditions, for said prolonged time.

In another aspect, this invention provides a method for increasing the speed of a color record in a color reversal film upon prolonged processing time, said process comprising; subjecting, an exposed silver halide-based, color reversal film, having at least one color record, and having from about 0.01 to about 43 milligrams per square meter (preferably less than about 20mg per square meter, more preferably no more than 15 mg per square meter, and even more preferably no more than 10 or even 5 mg per square meter) of colloidal elemental silver in an interlayer that is operatively associated with (and preferably below) a light sensitive, silver halide emulsion layer of said record, to black and white development, by contacting said exposed film with a black and white developing agent for a prolonged time, which time is sufficient to confer, in said record, a photographic speed that is faster than the speed achieved by subjecting said film, without said amount of colloidal silver, to development, under substantially similar process conditions, with said black and white developing agent for said prolonged time.

In another aspect this invention provides a method for increasing the photographic speed of a color record in a silver halide-based, color reversal film (a) having at least two color records, each of which is primarily responsive to a different region of the visible electromagnetic spectrum, and (b) having from about 0.01 to about 43 milligrams per square meter of colloidal elemental silver (preferably less than about 20 mg per square meter, more preferably no more than 15 mg per square meter, and even more preferably no more than 10 or even 5 mg per square meter) in an interlayer that is operatively associated with (and preferably below) a light sensitive, silver halide emulsion layer of at least one of said color records; said process comprising subjecting said color reversal film, after exposure, to black and white development for a prolonged time, which time is sufficient to achieve in a color record which is intimately associated with said interlayer; a photographic speed that is faster than the speed for said film without said amount of colloidal silver, at said prolonged processing time; and subsequently color developing said film, whereby an improved color balance between said records is achieved.

Description of Preferred Embodiments

Color reversal photographic elements of this invention typically comprise a photographic support having coated thereon a silver halide emulsion sensitized to red light within which a cyan dye image can be produced. Overlying the red sensitized silver halide emulsion layer is a silver halide emulsion sensitized to green light within which a magenta dye image can be produced. Overlying the green sensitized silver halide emulsion layer is a silver halide emulsion layer sensitive to blue light within which a yellow dye image can be produced. In some elements one or more of the variously sensitized silver halide emulsions are formed as two or more separate layers of unequal speed. It is also conventional practice to interpose one or more gelatin interlayers between the red sensitized and the green sensitized silver halide emulsion layers to insure their separation in coating.

In a preferred application of this invention a photographic element is provided comprised of three separate imaging units or records, each responsive within a separate third of the visible spectrum. One of the imaging units contains a blue-sensitive silver halide emulsion. As employed herein, reference to blue-sensitive silver halide emulsions indicates that they are intended to record primarily light received on exposure of a wavelength below 500 nm. However, blue-sensitive emulsions can be spectrally sensitized so that they absorb some light beyond 500 nm. The two remaining imaging units contain green and red spectrally sensitized silver halide emulsions, respectively. Green and red spectrally sensitized emulsions possess a native absorptivity for blue light, but are usually located to avoid exposure to blue light, and therefore have little response to blue light upon exposure of the photographic element. Green sensitized emulsions are those which absorb light upon exposure in a photographic element primarily within the range of from 500 to 600 nm. Such emulsions frequently absorb some light outside this range. Similarly red sensitized emulsions are those which absorb visible light primarily above 600 nm upon exposure in a photographic element. Red sensitized emulsions frequently absorb some light outside this range. Any of the blue, green and red emulsion layers can be layers viz, layers which are efficaciously altered i.e. (improved) by this invention. In a preferred form, all of the blue, green and red emulsion layers can be improved layers. In many practical applications it is particularly desired that the green emulsion layer be improved by this invention, since favorable effects are most typically needed in this layer to produce a pleasing photographic image.

The photographic elements formed according to this invention include at least one "target" layer—that is, one silver halide emulsion layer in which a favorable speed effect can be obtained—and at least one layer according to this invention, which is a layer comprising colloidal silver as discussed below. The target layer can take the form of any conventional silver halide layer employed as a dye image-forming layer in a color reversal photographic element. The target layer is comprised of (i) silver halide grains capable of forming a latent image upon imagewise exposure, and (ii) a hydrophilic colloid. The silver halide can be any photographic silver halide, such as silver chloride, silver bromide, silver bromoiodide, silver chlorobromoiodide and mixtures thereof. The silver halide grains which form latent images upon exposure are, of course, negative working, since development of the latent image sites formed on exposure produce a negative of the exposure image.

The silver halide grains of the target layer are suspended in a hydrophilic colloid photographic vehicle. Suitable hydrophilic colloid vehicle materials which can be used alone and in combination include both naturally occurring substances such as proteins, for example, gelatin, (e.g. ossein) gelatin derivatives, cellulose derivatives, polysaccharides such as dextran, gum arabic and the like; and synthetic polymeric substances such as water soluble polyvinyl compounds like poly(-vinylpyrrolidone), acrylamide polymers and the like.

Other synthetic polymeric vehicle compounds that can be used in combination with the hydrophilic colloid vehicle materials, include compounds such as dispersed vinyl compounds, such as those in latex form, and particularly those which increase the dimensional stability of the photographic materials. Typical synthetic polymers include those described in Nottorf U.S. Pat. No. 3,142,568 issued Jul. 28, 1964; White U.S. Pat. No. 3,193,386 issued Jul. 6, 1965; Houck et al U.S. Pat. No. 3,062,674 issued Nov. 6, 1962; Houck et al U.S. Pat. No. 3,220,844 issued Nov. 30, 1965; Ream et al U.S. Pat. 3,287,289 issued Nov. 22, 1966; and Dykstra U.S. Pat. No. 3,411,911 issued Nov. 19, 1968. Other vehicle materials include those water-insoluble polymers of alkyl acrylates and methacrylates, acrylic acid, sulfoalkyl acrylates or methacrylates, those which have crosslinking sites which facilitate hardening or curing as described in Smith U.S. Pat. No. 3,488,708 issued Jan. 6, 1970, and those having recurring sulfobetaine units as described in Dykstra Canadian Patent No. 774,054.

In addition to at least one target layer in which a favorable speed effect is to be produced, the photographic elements formed according to our invention include at least one layer of this invention. The inventive layer can take the form of any conventional non-image forming layer in color reversal elements. The inventive layer contains enough colloidal elemental silver to produce the desired speed effect in the target layer. The colloidal silver may be any colloidal elemental silver of the types commonly employed in the photographic arts. For example, the colloidal elemental silver may be yellow colloidal silver, i.e. Carey Lea silver, or black or grey/black colloidal silver, of the types known in the photographic arts, or similar thereto. In general, such silver colloids contain silver particles having a size within the range of from about 50 to about 100 angstroms. These silver colloids are generally formed in gelatin or other hydrophilic colloid of the type described above. For example, Carey Lea silver is generally prepared by a process comprising silver reduction in a basic solution obtained by reacting dextrin and silver nitrate. In many instances phthalated gelatin is added to facilitate washing the product. Finally, type IV gelatin is frequently added as a makeup gelatin.

For the purposes of this invention, an efficacious amount of colloidal silver is used in the inventive layer. Thus, an amount of colloidal silver sufficient to cause the desired speed effect on push processing is used; however, the amount should not be so large as to cause an undesired effect to the extent that the undesired effect cannot be readily tolerated. In general, layers of this invention contain from about 0.01 to about 43 mg per square meter of colloidal silver, however amounts slightly above and below this range can be used. More preferably, the amount of colloidal silver is from about less than about 20mg per square meter, more preferably no more than 15 mg per square meter, and even more preferably no more than 10 or even 5 mg per square meter (and further preferably at least 1.08 mg per square meter).

In a preferred embodiment, the layer of colloidal elemental silver employed in this invention is used as an interlayer adjacent to one of the silver halide-based light sensitive emulsion layers whose speed from push processing is to be altered. However, it is not necessary for the layer comprising colloidal silver to be adjacent to the silver halide layer as described above. In some instances, it is only necessary for the layer of colloidal silver to be close enough to the light sensitive layer so that the desired speed effect can be achieved during the time in which the film is being developed in the first developer. Layers which are adjacent or close enough to the silver halide layer are herein designated as "operatively associated" with the light sensitive layer or record.

The photographic elements formed according to our invention can be any convenient conventional form. In one preferred form the photographic elements formed according to the invention are color reversal photographic elements containing incorporated dye-forming couplers. In an illustrative form such a photographic element can be comprised of a plurality of layers arranged in the sequence recited below.

I. PHOTOGRAPHIC SUPPORT

Exemplary preferred photographic support include cellulose acetate and poly(ethylene terephthalate) film supports and photographic paper supports, especially paper support which is partially acetylated or coated with baryta and/or alpha-olefin polymer, particularly a polymer of an alpha-olefin containing 2 to 10 carbon atoms such as polyethylene, polypropylene, ethylenebutene copolymers and the like.

II. SUBBING LAYER

To facilitate coating on the photographic support it is preferred to provide a gelatin or other conventional subbing layer or combination of subbing layers. This layer, and/or layers IV and VI below, may contain colloidal elemental silver, e.g. yellow colloidal silver, in accordance with this invention.

III. RED SENSITIZED SILVER HALIDE EMULSION UNIT

At least one layer comprised of a red sensitized silver halide emulsion, as described above, is provided. At least one conventional cyan dye image-forming coupler is included, such as, for example, one of the cyan dye-forming couplers disclosed in the following U.S. Pat. Nos. 2,423,730; 2,706,684; 2,725,292; 2,772,161; 2772,162; 2,801,171; 2,895,826; 2,908,573; 2,920,961; 2,976,146; 3,002,836; 3,034,892; 3,148,062; 3,214,437; 3,227,554; 3,253,924; 3,311,476; 3,419,390; 3,458,315 and 3,476,563.

IV. INTERLAYER

At least one hydrophilic colloid interlayer, preferably a gelatin interlayer which includes a reducing agent, such as aminophenol or an alkyl substituted hydroquinone, is provided. Other reducing agents such as hydrazides as disclosed in U.S. Pat. No. 4,923,787 may be substituted for hydroquinones. A diffusible 4-thiazoline-2-thione compound as disclosed in U.S. Pat. Nos. 3,536,487 and 5,041,367 may be included.

V. GREEN SENSITIZED SILVER HALIDE EMULSION UNIT

At least one layer comprised of a green sensitized silver halide emulsion, as described above, is provided. At least one conventional magenta dye image-forming coupler is included, such as for example, one of the magenta dye-forming couplers disclosed in the following U.S. Pat. Nos. 2,725,292; 2,772,161; 2,895,826; 2,908,573; 2,920,961; 2,933,391; 2,983,608; 3,005,712; 3,006,759; 3,062,653; 3,148,062; 3,152,896; 3,214,437; 3,227,554; 3,253,924; 3,311,476; 3,419,391; 3,342,521 and 3,519,429.

VI. INTERLAYER

An interlayer of the type described above.

VII. BLUE-SENSITIVE SILVER HALIDE EMULSION UNIT

At least one layer comprised of a blue-sensitive silver halide emulsion is provided, as described above as useful in the red sensitized silver halide emulsion unit III and the green sensitized silver halide emulsion unit V, differing primarily only in lacking a green or red sensitizer, but preferably including a blue sensitizer. At least one conventional yellow dye image-forming coupler is included, such as, for example, one of the yellow dye-forming couplers disclosed in the following U.S. Pat. Nos. 2,875,057; 2,895,826; 2,908,573; 2,920,961; 3,148,062; 3,227,554; 3,253,924; 3,265,506; 3,277,155; 3,369,895; 3,384,657; 3,408,194; 3,415,652 and 3,447,928.

VIII. OVERCOAT LAYER

At least one overcoating layer is provided. Such layers are typically transparent gelatin layers and contain known addenda for enhancing coating, handling and photographic properties.

Further disclosure re emulsions, sensitizing dyes, desensitizers, antifoggants, stabilizers, color materials, vehicles, vehicle extenders, hardeners, coating aids, plasticizers, absorbing dyes, and supports useful in this invention are within Research Disclosure 308, Dec. 1989, pp. 993-1015.

It is to be understood that the colloidal silver used in accordance with this invention is generally incorporated in one or more interlayers positioned as generally indicated above. It is also to be understood that the color reversal elements of this invention can have other layers such as those employed in the photographic arts. For example, there may be antihalation layers, and interlayer associated with silver halide layers, or an ultraviolet light absorbing layer.

Thus, in accordance with the above, the location of the colloidal elemental silver can be selected to accomplish the desired result. This invention can improve color balance throughout the exposure scale and not have a substantial adverse effect on D min.

The color reversal materials of this invention have a gamma of from about 1.0 to about 3.0.

Forming a reversal color image according to this invention can be readily accomplished using photographic elements as described above. Following imagewise exposure, the photographic elements are given a first development in a silver halide developer solution.

Typically the first developer solution is a black-and-white developer—that is, it is devoid of developing agents which when oxidized will react with photographic couplers to produce dyes. During the first development step, silver halide grains which were imagewise exposed are reduced to silver.

The next reversal processing step is to render the remaining silver halide grains developable. This can be done by any conventional technique, including, for example, by fogging techniques for producing surface fogged silver halide grains. Typically, either a uniform exposure of the photographic element, or one more nucleating agents are employed to render the remaining silver halide in the photographic element developable.

Once the remaining silver halide grains are developable, the photographic element is placed in a color developer solution. The color developer solution can be of any conventional type. The color developer solution is so termed, since it contains at least one color developing agent—that is, a developing agent, such as an aminophenol or p-phenylenediamine having a primary amine group, and capable of entering into a redox reaction with silver halide, and thereafter reacting with a photographic coupler to form a dye. The photographic coupler (or an equivalent dye image former) can be present in either the photographic element or the color developer solution.

The process described above can be conducted according to any means well known in the photographic arts. Black-and-white developer solutions, hardener baths, stop baths, fix baths are disclosed in *Processing Chemicals and Formulas*, 6th Edition, Eastman Kodak Company (1963). A discussion and comparison of commercial reversal color processes useful in the practice of this invention appears at Chapter 13, Practical Color Processes, *Photochemistry in Black-and-White and Color Photography*, Eastman Kodak Company (1975). Exemplary of a preferred processing technique for color reversal photographic elements is that disclosed in *The British Journal of Photography Annual* (1973) pp. 208-210.

In a preferred embodiment, this invention comprises use of the E-6 process, modified for push processing by the longer time in the first developer. In general, the process of this invention comprises an extended, or prolonged time, which is at least about 0.5 minutes longer than the normal time specified for the process. Thus, if the normal time in the first developer is 6.0 minutes, then the prolonged time for this invention is normally at least 6.5 minutes. In general, the prolonged time, i.e. the time in the first developer is 6.5 to 15 minutes, more preferably 7 to 13 minutes.

Thus, in a preferred embodiment the present invention is used with the well known, widely employed E-6 color reversal development process described in the Eastman Kodak Company publication, Manual for Processing Kodak EKTACHROME Films using E-7 (1980), or a substantially equivalent process.

A typical fresh tank formulation of an E-6 nonchromogenic developer for use in developing color reversal film is as follows.

TABLE I

| First Developer | Fresh Tank |
|---|---|
| pH @ 25° C. | 9.65 ± 0.03 |
| Specific Gravity @ 27° C. | 1.062 ± 0.003 |
| Kodak Developing Agent DA-1 (Potassium Hydroquinone Monosulfonate) | 23.5 ± 1.0 g/L |
| Kodak Dimezone S Developing Agent (4-hydroxymethyl-4-methyl-1-phenyl-3-pyrazolidinone) | 1.5 ± 0.1 g/L |
| Potassium Sulfite (45% solution) | 45.5 ± 3.0 ml/L |
| Sodium Thiocyanate (51% solution) | 1.00 ± 0.05 g/L |
| Sodium Bromide | 2.54 ± 0.10 g/L (includes starter) |
| Potassium Iodide | 4.5 ± 0.5 mg/L (includes starter) |
| Other components in solution: (quantities are fresh tank based on concentrate diluted to tank strength). | |
| Potassium Hydroxide (45% solution) | 6.5 ml/L |
| Aminotris (methylphosphonic acid), pentasodium salt, 40% solution (Kodak Antical #4) | 1.00 ml/L |
| Pentetic Acid, pentasodium salt, 40% solution (Kodak Antical #8) | 4.80 ml/L |
| Potassium Carbonate (47% solution) | 14.0 g/L |
| Sodium Bicarbonate | 12.0 g/L |

During use, the solution will gain bromide, iodine, filter dyes, adsorber dyes, sensitizing dyes, surfactants and other ingredients from the film.

As is well known, the E-6 process entails processing exposed film for example, as follows:

TABLE II

| Step | Time | Solution | Function |
|---|---|---|---|
| 1 | 6 min. | First developer | develop silver |
| 2 | 2 min. | First wash | stop development |
| 3 | 2 min. | Reversal bath | fog silver halide |
| 4 | 6 min. | Color developer | develop silver, form dye |
| 5 | 2 min. | Conditioner | "stop" prepare for bleach |
| 6 | 6 min. | Bleach | oxidize Ag to AgBr |
| 7 | 4 min. | Fix | remove AgBr |
| 8 | 4 min. | Final wash | clean |
| 9 | 1 min. | Stabilizer | stabilize magenta coupler |

Modifications of the process can entail Step 5 comprising pre-bleaching to stabilize magenta coupler, stop, and prepare for leach, and Step 9 comprising a final rinse to prevent water spotting.

The process of this invention comprises use with the first development step modified by the prolonged first developer times discussed above. Thus the process of this invention comprises a quality control method for the non-chromogenic developer employed to process reversal film.

Typical specifications for the aforementioned E-6 process and similar processes are as follows:

TABLE III

| Solution | Time (In Minutes) | Temperature °F. | °C. |
|---|---|---|---|
| First Developer | 6' | 100.4 ± 0.5 | 38.0 ± 0.3 |
| Water Wash 2 gal/min = 7.5 l/min | 2' | 92–103 | 33–39 |
| Reversal Bath | 2' | 75–103 | 24–39 |
| Color Developer | 6' | 100.4 ± 1.1 | 38.0 ± 0.6 |
| Conditioner | 2' | 75–103 | 33–39 |
| Bleach | 6' | 92–103 | 33–39 |
| Fixer | 4' | 92–103 | 33–39 |
| Water Wash 2 gal/min = 7.5 L/min | 4' | 92–103 | 33–39 |

TABLE III-continued

| Solution | Time (In Minutes) | Temperature °F. | °C. |
|---|---|---|---|
| Stabilizer | 1' | RT* | |
| Dryer | | RT*–140° | RT–60° |

*RT = room temperature

EXAMPLE 1

A color reversal photographic element was prepared using spectrally sensitive tabular silver halide emulsions in blue, green and red sensitive layers. In the following description, the levels of all materials are given in mg/m$^2$; thus for example, in Layer 1, gelatin was present in an amount equal to 979 mg/m$^2$, and Carey Lea silver in an amount equal to 2.7 mg/m$^2$. The Carey Lea silver in that layer, was employed for an art recognized use, as is the grey silver (another form of colloidal silver) used in layer (14). The Carey Lea silver employed in accordance with this invention is in layer (5) and in (13).

FILM STRUCTURE (1) Protective layer: gelatin-979, silver bromide emulsion-123, Carey Lea silver-2.7

(2) Protective layer: gelatin-1399, UV absorbing materials-377

(3) Fast Yellow Emulsion layer: gelatin-2370, blue-sensitive silver bromoiodide (3.0% iodide) emulsion-646, yellow dye forming coupler-1560

(4) Slow Yellow Emulsion layer: gelatin-861, blue-sensitive silver bromoiodide (3.0% iodide) emulsion-474, yellow dye forming coupler-215, Lippmann emulsion-14

(5) Interlayer: gelatin-614, oxidized developer scavenger-108, blue light absorbing material-215, Carey Lea silver-2.2

(6) Interlayer: gelatin-2152

(7) Fast Magenta Emulsion layer: gelatin-1511, green-sensitized silver bromoiodide (4.0% iodide) emulsion-495, magenta dye forming coupler-969, Lippmann emulsion-65

(8) Slow Magenta Emulsion layer: gelatin-828, green-sensitive silver bromoiodide (4.0% iodide) emulsion-592, magenta dye forming coupler-215, Lippmann emulsion-11

(9) Interlayer: gelatin-614, green light absorber-65

(10) Interlayer: gelatin-570, oxidized developer scavenger-162

(11) Fast Cyan Emulsion layer: gelatin-1511, red-sensitive silver bromoiodide (4.0% iodide) emulsion-544, cyan dye forming coupler-969, Lippmann emulsion-65

(12) Slow Cyan Emulsion layer: gelatin-861, red-sensitive silver bromoiodide (4.0% iodide) emulsion-592, cyan dye forming coupler-194, Lippmann emulsion-32

(13) Interlayer: gelatin-1226, Carey Lea silver-6.5

(14) Antihalation layer: gelatin-2442, grey silver-377

Levels of all materials are given in units of mg/m$^2$.

A sample was exposed through a step tablet for 0.01 second by a 600 watt 2850° K light source through a 0.3 neutral density filter and a daylight V filter. The exposed material was then processed according to Kodak's E-6 reversal process for 6 minutes, and push processed for 11 minutes in the first developer.

Using a standard densitometer and a status A filter, densitometric measurements were made.

The speeds of each of the three light sensitive records was determined at five density points at 6 and 11 minutes in the black-and-white developer.

Subtraction of the six minute speeds from the eleven minute speeds at each density point yielded the net speed increase for the three light sensitive color units. As can be seen from Table IV, the multilayer materials of this invention containing Carey Lea silver in proximity to the low sensitivity red sensitive layer gained a larger net speed increase, thus minimizing the objectionable cyan color balance shift of the control coating. From Table IV, the smaller net speed increase of the blue sensitive layer is also apparent.

TABLE IV

EFFECT OF CLS* NET SPEED INCREASE OF RED RECORD

| Density | Color | Net Speed Increase CLS* coated at mg/m² 0.0 | 6.5 |
|---|---|---|---|
| 2.0 | Cyan | 35 | 42 |
| | Magenta | 50 | 46 |
| | Yellow | 32 | 32 |
| 1.8 | Cyan | 34 | 40 |
| | Magenta | 48 | 46 |
| | Yellow | 36 | 35 |
| 1.4 | Cyan | 40 | 46 |
| | Magenta | 49 | 47 |
| | Yellow | 43 | 43 |
| 1.0 | Cyan | 47 | 54 |
| | Magenta | 55 | 50 |
| | Yellow | 51 | 50 |
| 0.5 | Cyan | 54 | 58 |
| | Magenta | 66 | 66 |
| | Yellow | 56 | 56 |

*Carey Lea silver

EXAMPLE 2

To show the applicability of this invention to the treatment of blue sensitive layers, multilayer photographic materials, were prepared with various amounts of Carey Lea silver (CLS) in an interlayer adjacent to a low sensitivity blue sensitive emulsion layer, which in turn was adjacent to a high sensitivity blue sensitive emulsion layer. The samples were exposed and processed, and densitometric measurements were taken as described above. The results are set forth in Table V.

This element was similar to the element shown in Example 1 except where noted below.

Layer 3 Fast yellow emulsion layer: blue-sensitive emulsion-753, coupler-1670

Layer 4 Slow yellow emulsion layer: blue-sensitive emulsion-247, coupler-538, Lippmann emulsion-0

Layer 5 Interlayer: blue light absorbing material-172, Carey Lea silver-0

Layer 7 Fast magenta emulsion layer: gelatin-1670, green-sensitive emulsion-463, Lippmann emulsion-0

Layer 8 Slow magenta emulsion layer: Lippmann emulsion-0

Layer 11 Fast cyan emulsion layer: gelatin-1780, red-sensitive emulsion-646, coupler-1040, Lippmann emulsion-0

Layer 12 Slow cyan emulsion layer: red-sensitive emulsion-635, Lippmann emulsion-43

TABLE V

EFFECT OF CLS ON NET SPEED INCREASE OF BLUE RECORD

| Density | Color | Net Speed Increase; CLS coated at mg/m² 0.0 | 11.0 | 22.0 | 44.0 |
|---|---|---|---|---|---|
| 2.0 | Cyan | 47 | 46 | 50 | 54 |
| | Magenta | 38 | 46 | 50 | 55 |
| | Yellow | 30 | 42 | 43 | 48 |
| 1.8 | Cyan | 42 | 43 | 43 | 48 |
| | Magenta | 39 | 43 | 47 | 51 |
| | Yellow | 30 | 42 | 43 | 45 |
| 1.4 | Cyan | 40 | 41 | 41 | 44 |
| | Magenta | 41 | 43 | 44 | 46 |
| | Yellow | 34 | 44 | 44 | 48 |
| 1.0 | Cyan | 43 | 46 | 44 | 48 |
| | Magenta | 45 | 46 | 47 | 50 |
| | Yellow | 39 | 50 | 51 | 53 |
| 0.5 | Cyan | 50 | 50 | 52 | 54 |
| | Magenta | 54 | 53 | 53 | 54 |
| | Yellow | 45 | 62 | 64 | 68 |

As can be seen from Table V, the multilayer coatings of this invention containing Carey Lea silver (CLS) in proximity to the low sensitivity blue sensitive layer gained a larger net speed increase, thus minimizing the objectionable yellow color balance shift of the control coating. It is also apparent that the effects are diminished as the amounts of colloidal silver are raised and continued increases in the amount of colloidal silver beyond what is required for this invention may result in deleterious losses of maximum densities.

EXAMPLE 3

A color reversal photographic element was prepared using spectrally sensitive conventional single run ammoniacal digested silver halide emulsions in blue, green and red sensitive layers. The element is described below.

FILM STRUCTURE

Layer 1 Surface overcoat

Layer 2 Ultra violet absorber layer

Layer 3 Fast yellow emulsion layer: gelatin-2691, blue-sensitive silver bromoiodide emulsion-1050, yellow dye forming coupler-1578

Layer 4 Slow yellow emulsion layer: gelatin-807, blue-sensitive silver bromoiodide emulsion-315, yellow dye forming coupler-442

Layer 5 Interlayer: gelatin-611, Carey Lea silver-74

Layer 6 Interlayer: gelatin-611

Layer 7 Fast magenta emulsion layer: gelatin 1737, green-sensitive bromoiodide emulsion-758, magenta dye forming coupler-736

Layer 8 Slow magenta emulsion layer: gelatin 2215, green-sensitive bromoiodide emulsion-433, magenta dye forming coupler-446

Layer 9 Interlayer: gelatin-611

Layer 10 Fast cyan emulsion layer: gelatin 1442, red-sensitive bromoiodide emulsion-794, cyan dye forming coupler-856

Layer 11 Slow cyan emulsion layer: gelatin 1421, red-sensitive bromoiodide emulsion-437, cyan dye forming coupler-446

Layer 12 Interlayer: gelatin-1227

Layer 13 Antihalation layer: gelatin-2411, grey silver-339

Elements of this invention were prepared by coating Carey Lea silver in an intermediate layer adjacent to the high sensitivity green sensitive layer (layer 7). Another intermediate layer adjacent to and on the other side of the above mentioned interlayer was also present. The total amount of Carey Lea silver in the two interlayers was held constant at 74.0 mg/m$^2$ as indicated in Table VI. The samples were exposed, and processed, and densitometric measurements were taken as described above.

TABLE VI

EFFECT OF CLS ON NET SPEED INCREASE OF GREEN RECORD

| | | CLS coated at mg/m$^2$ | | | |
|---|---|---|---|---|---|
| Layer 5 | | 74.0 | 63.0 | 52.0 | 41.0 |
| Layer 6 | | 0.0 | 11.0 | 22.0 | 33.0 |
| Density | Color | Net Speed Increase | | | |
| 2.2 | Cyan | 40 | 42 | 41 | 39 |
| | Magenta | 30 | 33 | 41 | 46 |
| | Yellow | 45 | 48 | 48 | 52 |
| 2.0 | Cyan | 40 | 41 | 43 | 39 |
| | Magenta | 31 | 31 | 33 | 41 |
| | Yellow | 46 | 46 | 47 | 49 |
| 1.8 | Cyan | 43 | 42 | 44 | 41 |
| | Magenta | 32 | 32 | 33 | 39 |
| | Yellow | 47 | 48 | 48 | 48 |
| 1.4 | Cyan | 49 | 47 | 48 | 45 |
| | Magenta | 36 | 36 | 36 | 40 |
| | Yellow | 53 | 54 | 55 | 54 |

As can be seen from Table VI the multilayer coatings of this invention containing CLS in proximity to the high sensitivity green sensitive layer gained a larger net speed increase, especially at the high density regions, thus minimizing an objectionable magenta color balance shift apparent in the control coating where all the CLS was coated in the intermediate layer not in proximity to the high sensitivity green sensitive layer.

The invention has been fully described above with particular reference to preferred embodiments. A skilled practitioner, familiar with the above detailed description, can make many modifications and substitutions without departing from the scope and spirit of the claims which follow.

We claim:

1. A method for increasing the speed of a color record in a color reversal film upon prolonged processing time, said process comprising; subjecting, an exposed silver halide-based, color reversal film, having at least one color record, and having from about 0.01 to less than 20 milligrams per square meter of colloidal elemental silver in an interlayer that is operatively associated with, and below, a light sensitive, silver halide emulsion layer of said record, to black and white development, by contacting said exposed film with a black and white developing agent for a prolonged time, which time is sufficient to confer, in said record, a photographic speed that is faster than the speed achieved by subjecting said film, without said amount of colloidal silver to development, under substantially similar process conditions, with said black and white developing agent for said prolonged time.

2. The method of claim 1 wherein said interlayer contains no more than 15 mg per square meter of colloidal elemental silver.

3. The method of claim 1 wherein said developing agent is a mixture of 4-hydroxymethyl-4-methyl-1-phenyl-3-pyrazolidinone, and potassium hydroquinone monosulfonate.

4. The method of claim 3 wherein said prolonged time is from about 6.5 to about 15 minutes.

5. The method of claim 1 wherein said colloidal silver is Carey Lea silver.

6. A method for increasing the photographic speed of a color record in a silver halide-based, color reversal film (a) having at least two color records, each of which is primarily responsive to a different region of the visible electromagnetic spectrum, and (b) having from about 0.01 to less than 20 milligrams per square meter of colloidal elemental silver in an interlayer that is operatively associated with a light sensitive, silver halide emulsion layer of at least one of said color records;

said process comprising subjecting said color reversal film, after exposure, to black and white development for a prolonged time, which time is sufficient to achieve in a color record which is intimately associated with said interlayer;

a photographic speed that is faster than the speed for said film without said amount of colloidal silver, at said prolonged processing time;

and subsequently color developing said film, whereby an improved color balance between said records is achieved.

7. The method of claim 6 wherein said interlayer contains from about 1.08 mg to 15 mg per square meter of colloidal elemental silver.

8. The method of claim 6 wherein said interlayer is adjacent to a light sensitive silver halide layer in said record for which an increase in speed is achieved.

9. The method of claim 8 wherein said interlayer is below a red light sensitive layer in the red record of said film.

10. The method of claim 8 wherein said interlayer is below a blue light sensitive layer in the blue record of said film.

11. The method of claim 6 wherein said interlayer is non-adjacent to a light sensitive silver halide layer in said record for which an increase in speed is achieved.

12. The method of claim 6 wherein said colloidal silver is Carey Lea silver.

13. An improved color reversal film suitable for push processing having from about 1.08 to less than 20 mg per square meter of colloidal elemental silver in a layer that is operatively associated with a light sensitive, silver halide based layer of a color record; said film being further characterized by achieving, after exposure and subjecting said film to black and white development for a prolonged time, a photographic speed in said record which is faster than that achieved by said record by subjecting said film ,without said amount of colloidal silver to development with said black and white developer under substantially similar processing conditions, for said prolonged time.

14. A color reversal film according to claim 13 wherein said interlayer contains no more than 15 mg per square meter of colloidal elemental silver.

15. A color reversal film according to claim 13 wherein said layer is an interlayer adjacent to a light sensitive silver halide layer in said record for which an increase in speed is achieved.

16. A color reversal film according to claim 13 wherein said layer is an interlayer which is non-adjacent to light sensitive silver halide layer in said record for which an increase in speed is achieved.

17. A color reversal film according to claim 13 wherein said layer is an interlayer below a red light sensitive layer in the red record of said film.

18. A color reversal film according to claim 13 wherein said layer is an interlayer below a blue light sensitive layer in the blue record of said film.

19. A color reversal film according to claim 13 wherein said colloidal silver is Carey Lea Silver.

* * * * *